US010202951B2

(12) United States Patent
Feulner et al.

(10) Patent No.: US 10,202,951 B2
(45) Date of Patent: Feb. 12, 2019

(54) HANDHELD WORK APPARATUS HAVING A PUMP, SAID PUMP AND PUMP BULB THEREFOR

(71) Applicant: Andreas Stihl AG & Co. KG, Waiblingen (DE)

(72) Inventors: Robert Feulner, Waiblingen (DE); Harald Buehner, Rudersberg (DE); Ricardo Hojczyk, Waiblingen (DE); Tobias Bernhard, Obrigheim-Asbach (DE)

(73) Assignee: Andreas Stihl AG & Co. KG, Waiblingen (DE)

( * ) Notice: Subject to any disclaimer, the term of this patent is extended or adjusted under 35 U.S.C. 154(b) by 576 days.

(21) Appl. No.: 14/548,163

(22) Filed: Nov. 19, 2014

(65) Prior Publication Data

US 2015/0136252 A1 May 21, 2015

(30) Foreign Application Priority Data

Nov. 19, 2013 (DE) ..... 10 2013 019 379

(51) Int. Cl.

| | |
|---|---|
| ***F04B 9/14*** | (2006.01) |
| ***F02M 37/04*** | (2006.01) |
| ***F02M 37/00*** | (2006.01) |
| ***F02M 37/16*** | (2006.01) |
| ***F02M 37/18*** | (2006.01) |

(Continued)

(52) U.S. Cl.

CPC ..... *F02M 37/046* (2013.01); *F02B 63/02* (2013.01); *F02M 1/16* (2013.01); *F02M 37/007* (2013.01); *F02M 37/0011* (2013.01); *F02M 37/0023* (2013.01); *F02M 37/16* (2013.01); *F02M 37/18* (2013.01); *F04B 9/14* (2013.01); *Y10T 137/85986* (2015.04)

(58) Field of Classification Search

CPC .. F02M 1/16; F02M 37/0011; F02M 37/0023; F02M 37/007; F02M 37/16; F02M 37/018; F02M 37/046; F04B 9/14

USPC ..... 123/179.11; 92/90

See application file for complete search history.

(56) References Cited

U.S. PATENT DOCUMENTS 2,562,317 A * 7/1951 Krall ..... B05B 11/3032 222/207

3,171,333 A 3/1965 Mandy (Continued)

FOREIGN PATENT DOCUMENTS

CN 102828853 A 12/2012

*Primary Examiner* — Essama Omgba

*Assistant Examiner* — Philip E Stimpert

(74) *Attorney, Agent, or Firm* — Walter Ottese, P.A.

(57) ABSTRACT

A handheld work apparatus has a fuel supply system and a pump for delivering fuel from the fuel supply system. The pump has an elastic pump bellows which can be actuated by the operator. The pump bellows has a fastening section at which the pump bellows is fastened to a housing. The pump bellows has a main section and a roof section, wherein the roof section has a dome-shaped section adjoining the main section and a cap which adjoins the dome-shaped section and closes off the dome-shaped section. In order to achieve a rapid return of the pump bellows from the actuated position, even at low temperatures, it is provided that the smallest wall thickness (g) of the main section is at least 10% greater than the smallest wall thickness (h) of the dome-shaped section.

10 Claims, 3 Drawing Sheets

(51) Int. Cl.
*F02M 1/16* (2006.01)
*F02B 63/02* (2006.01)

(56) References Cited

U.S. PATENT DOCUMENTS

| | | | | |
|---|---|---|---|---|
| 4,197,825 | A | 4/1980 | Altenbach | |
| 4,411,844 | A | 10/1983 | Morris et al. | |
| 5,435,230 | A * | 7/1995 | Phillips | F04B 45/02 417/437 |
| 5,803,035 | A | 9/1998 | Guntly | |
| 6,354,571 | B1 | 3/2002 | Gerhardy | |
| 6,533,254 | B1 | 3/2003 | Grifka et al. | |
| 6,595,500 | B2 | 7/2003 | Osburg et al. | |
| 7,152,852 | B1 | 12/2006 | Habu et al. | |
| 7,467,785 | B2 * | 12/2008 | Braun | F02M 17/04 123/179.11 |
| 2012/0067316 | A1 * | 3/2012 | Wireman | F02M 1/16 123/179.11 |
| 2013/0276724 | A1 | 10/2013 | Lank et al. | |

* cited by examiner

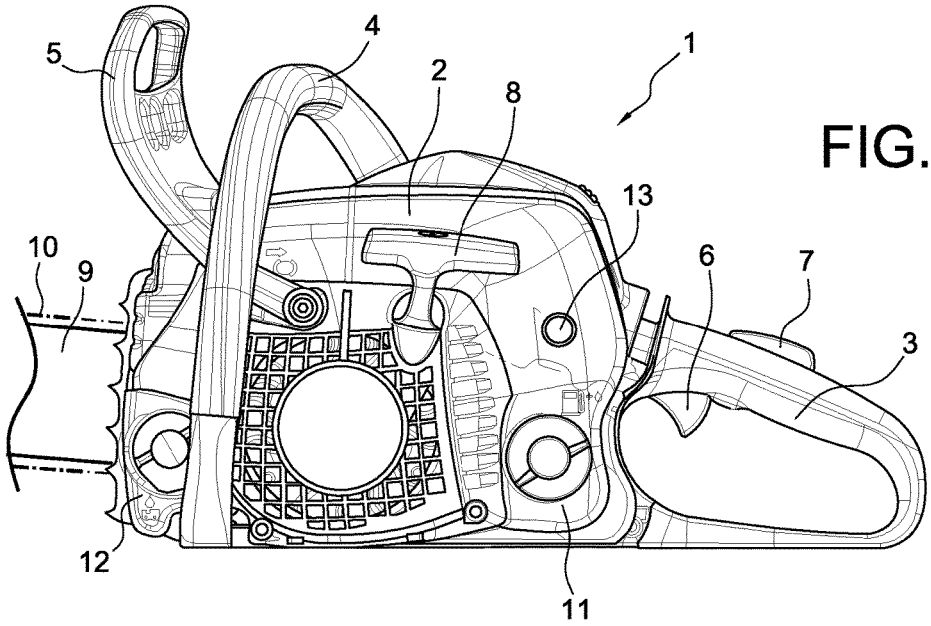
FIG. 1
FIG. 2
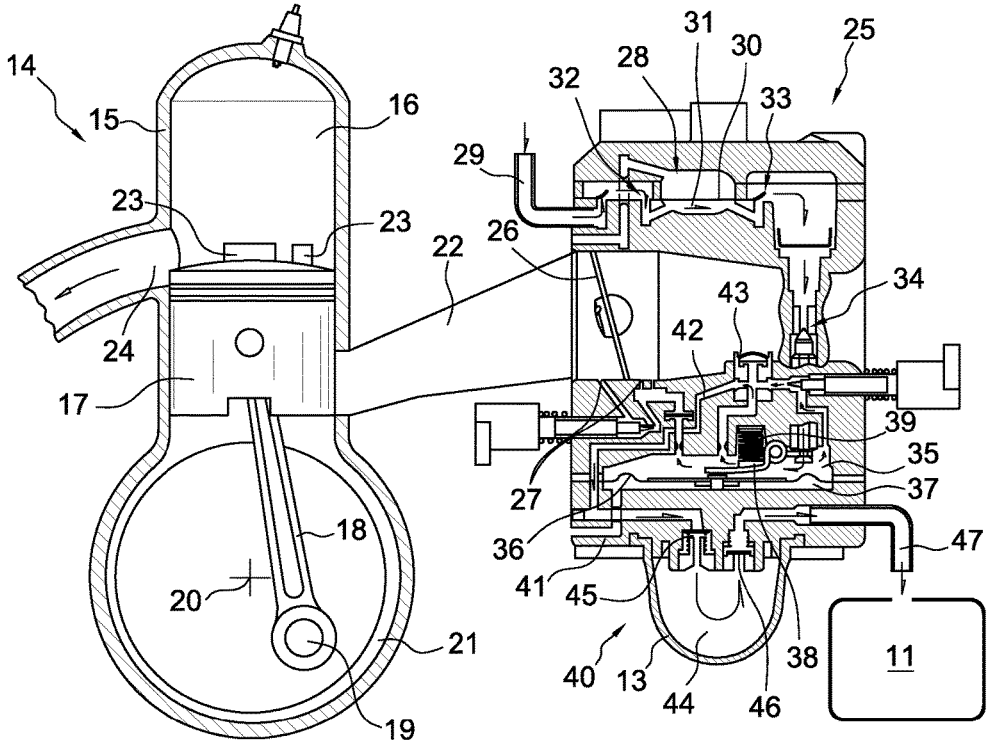

FIG. 5
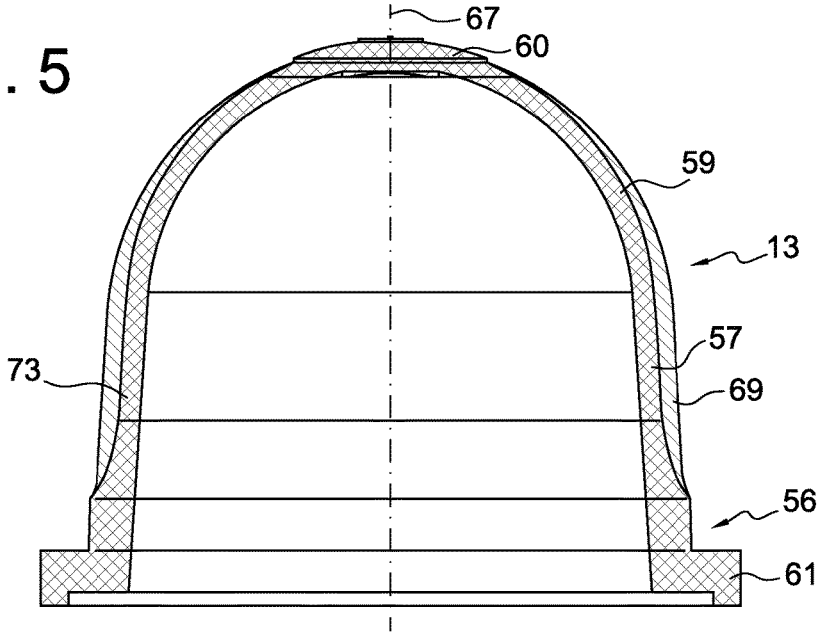
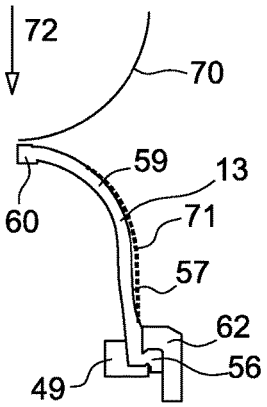
FIG. 6
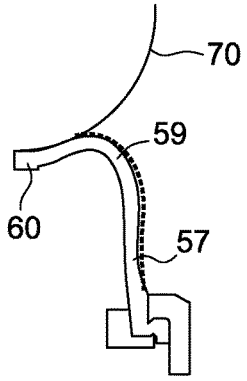
FIG. 7
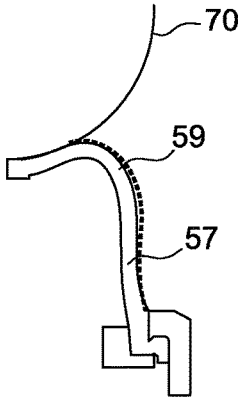
FIG. 8
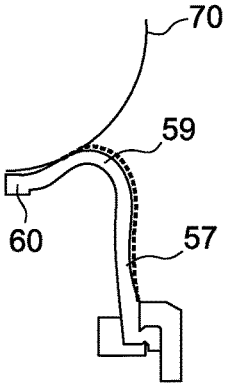
FIG. 9
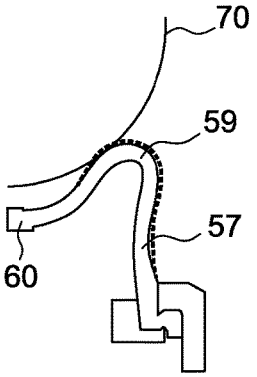
FIG. 10

HANDHELD WORK APPARATUS HAVING A PUMP, SAID PUMP AND PUMP BULB THEREFOR

CROSS REFERENCE TO RELATED APPLICATION

This application claims priority of German patent application no. 10 2013 019 379.6, filed Nov. 19, 2013, the entire content of which is incorporated herein by reference.

BACKGROUND OF THE INVENTION

U.S. Pat. No. 6,595,500 discloses a handheld work apparatus with a diaphragm carburetor which comprises a pump which is to be actuated by the operator. The pump is configured as a flushing pump and delivers fuel from the fuel system into the fuel tank. The pump has a pump bellows. The pump bellows is fixed by a fastening section to the carburetor housing. That region of the pump bellows which adjoins the carburetor housing has a constant wall thickness.

In order, in particular in the case of pumps with a large pump bellows and correspondingly large delivery volume, to achieve resetting forces of a sufficient magnitude in order to reset the pump bellows from the actuated, pushed-in position into the unactuated position, it is known to insert a helical compression spring into the interior of the pump bellows, the helical compression spring assisting the resetting of the pump bellows. As a result, a sufficiently rapid resetting of the pump bellows is achieved even at low temperatures.

SUMMARY OF THE INVENTION

It is an object of the invention to provide a handheld work apparatus of the type in question having a pump bulb or pump bellows applying resetting forces of a sufficient magnitude and which has a simple configuration. It is a further object of the invention to provide a simply configured pump and a pump bellows for a pump with a simple configuration.

It has been shown that a rapid resetting of the pump bellows from the pushed-in position into the starting position can be achieved by a thickening of the pump bellows in a main section of the pump bellows, which main section is arranged between the fastening section and the dome-shaped section. For this purpose, the wall thickness of the pump bellows in the main section is greater than the wall thickness of the dome-shaped section. The smallest wall thickness of the main section here is at least 10% greater than the smallest wall thickness of the dome-shaped section. The smallest wall thickness of the main section is advantageously at least 25%, in particular at least 50% greater than the smallest wall thickness of the dome-shaped section. This makes it possible to achieve large resetting forces, and, as a result, rapid resetting of the pump bellows into the unactuated state thereof, even at low temperatures. Owing to the fact that the wall thickness is smaller in the dome-shaped section and advantageously is not increased in comparison to known embodiments, the actuating force which is required for pushing in the dome-shaped section is increased only insubstantially. Upon actuation, the dome-shaped section is advantageously pushed from a convex shape into a concave shape. The force required for this remains substantially the same. Upon actuation, the wall in the main section is also pushed outward. The force required for this is increased by the increased wall thickness in the main section. At the same time, the resetting force is also increased.

The smallest wall thickness of the main section is advantageously at most 10% less than the greatest wall thickness of the main section. Accordingly, the wall thickness of the main section is approximately constant. The wall thickness of the main section is advantageously constant within the framework of the manufacturing accuracy. It is thereby possible to achieve high resetting forces and, as a result, a rapid resetting of the pump bellows into the starting position thereof. In the dome-shaped section, the wall thickness of the pump bellows is advantageously continuously reduced in the direction of the dome. As a result, the forces required for pushing in the pump bellows and for adjusting the dome-shaped section from the convex position into the concave position can be kept comparatively small.

The dome-shaped section advantageously extends over less than 50% of the height of the pump bellows. The main section is advantageously of comparatively high configuration, and therefore very high resetting forces can be achieved. The height of the main section is advantageously at least 20%, preferably at least 25% of the height of the pump bellows.

The dome-shaped section of the pump bellows is that section of the pump bellows in which the outer wall has an arcuate profile. The outer wall in the main section can have a slightly arcuate profile or a rectilinear profile, and specifically parallel to the center axis or slightly inclined in relation to the center axis of the pump bellows. In the dome-shaped section, the outer wall of the pump bellows in each sectional plane which contains the center axis of the pump bellows advantageously encloses an angle of more than 3° with the center axis at every point in the sectional plane. In the main section, the angle which is enclosed by the outer wall of the pump bellows with the center axis of the pump bellows is advantageously not more than 3°. The angle which is enclosed by the outer wall of the pump bellows with the center axis of the pump bellows advantageously increases continuously in the dome-shaped section. The dome-shaped section can have, for example, a profile in the shape of an arc of a circle.

That side of the main section which faces the dome-shaped section advantageously has a diameter which is at least 75% of the diameter of the main section on the side facing the fastening section. In particular, that side of the dome-shaped section which faces the main section has a diameter which is more than 90% of the diameter of the main section on the side facing the fastening section. Accordingly, the diameter of the main section is only slightly reduced from the side facing the fastening section to the side facing the dome-shaped section. A substantially constant outside diameter of the pump bellows in the main section may also be advantageous. However, a slight inclination of the side wall of the pump bellows in the main section in relation to the center axis may be advantageous for removing the pump bellows from a casting die or injection molding die. In the dome-shaped section, the outside diameter of the pump bellows advantageously greatly decreases. The largest diameter of the dome, which diameter corresponds to the smallest diameter of the dome-shaped section, is advantageously less than 50% of the largest outside diameter of the main section. The largest diameter of the dome is in particular less than 40% of the largest outside diameter of the main section. The ratio of the height of the main section to the largest diameter thereof is advantageously approximately 0.2 to approximately 0.4.

For a pump with a pump bellows, it is provided that the smallest wall thickness of the main section of the pump bellows is at least 10% greater than the smallest wall thickness of the dome-shaped section.

For a pump bellows for a pump, it is provided that the smallest wall thickness of the main section of the pump bellows is at least 10% greater than the smallest wall thickness of the dome-shaped section.

BRIEF DESCRIPTION OF THE DRAWINGS

The invention will now be described with reference to the drawings wherein:

FIG. 1 is a side view of a chain saw;

FIG. 2 shows a schematic of the internal combustion engine and of the fuel supply system for the internal combustion engine of the chain saw from FIG. 1;

FIG. 5 shows a sectional view corresponding to FIG. 4, with the configuration of known pump bellows being shown; and, FIGS. 6 to 10 show schematics of the deformation of the pump bellows at different stages of the actuation.

DESCRIPTION OF THE PREFERRED EMBODIMENTS OF THE INVENTION

Figure 3:
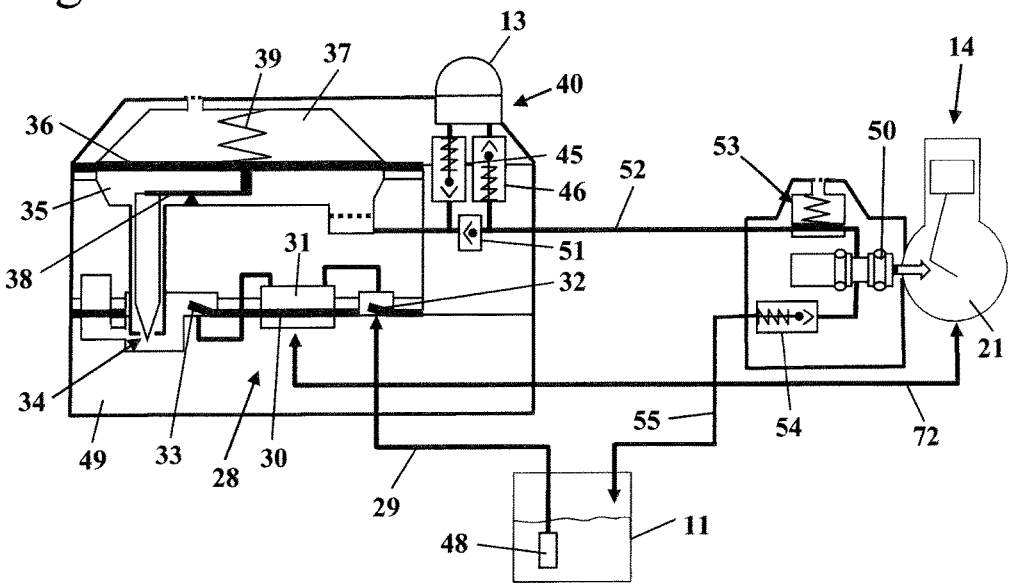
FIG. 3 shows a schematic of an alternative fuel supply system.

FIG. 1 shows a chain saw 1 as an exemplary embodiment of a handheld work apparatus. The chain saw 1 has a housing 2 on which a rear handle 3 and a handle tube 4 are arranged. On that side of the housing 2 which faces away from the rear handle 3, a guide rail 9, on which a saw chain 10 (only shown schematically in FIG. 1) is arranged in a revolving manner, projects forward. A throttle lever 6 and a throttle lever lock 7 are mounted pivotably on the rear handle 3. The throttle lever 6 serves for operating a drive motor which is arranged in the housing 2 and drives the saw chain 10 in a revolving manner on the guide rail 9. In order to start the drive motor, which is configured as an internal combustion engine 14 (FIG. 2) use is made of a starter handle 8 protruding from the housing 2. A hand protector bar 5 which can be mounted pivotably on the housing 2 and can serve for releasing a braking device (not shown) for the saw chain 10 is arranged on that side of the handle tube 4 which faces the guide rail 9. A fuel tank 11 is integrated on the housing 2 adjacent to the rear handle 3. A lubricating oil tank 12 is provided adjacent to the guide rail 9. A pump bulb or bellows 13, which is described in more detail below, protrudes from the housing 2.

FIG. 2 schematically shows the internal combustion engine 14 for driving the saw chain 10, and the fuel supply system for the internal combustion engine 14. The drawing here is not to scale.

In the exemplary embodiment, the internal combustion engine 14 is configured as a two-stroke engine and has a cylinder 15 in which a combustion chamber 16 is formed. The combustion chamber 16 is bounded by a piston 17 mounted in a reciprocating manner in the cylinder 15. The piston 17 uses a connecting rod 18 to drive a crank shaft 19, which is mounted rotatably about a rotation axis 20 in a crank case 21. In the region of the lower dead center of the piston 17, which is shown in FIG. 2, the interior space of the crank case 21 is connected via transfer channels 23 to the combustion chamber 16 such that a fuel/air mixture can pass from the crank case 21 into the combustion chamber 16. An outlet 24 which is controlled by the piston 17 leads out of the combustion chamber 16. An intake channel 22 which opens at the cylinder bore and is likewise controlled by the piston 17 serves for supplying a fuel/air mixture. A portion of the intake channel 22 is formed in a carburetor 25 which supplies fuel to the sucked-up combustion air. A throttle element 26 for controlling the supplied quantity of fuel/air mixture is mounted in that portion of the intake channel 22 which is formed in the carburetor 25. In the exemplary embodiment, the throttle element 26 is a throttle valve. In the region of the throttle element 26, secondary fuel openings 27 open into the intake channel 22. A main fuel opening 43 opens into the intake channel upstream of the throttle element 26.

A fuel pump 28 which is arranged in the housing 41 of the carburetor 25 is provided for supplying fuel. The fuel pump 28 is driven by the fluctuating pressure in the crank case 21. The fuel pump 28 is connected to the fuel tank 11 via a fuel line 29. Fuel is sucked up out of the fuel tank 11 via the fuel line 29. The fuel line 29 opens via an intake valve 32 into a fuel chamber 31 which is bounded by a pump diaphragm 30. The pump diaphragm 30 is drawn out of the fuel chamber 31 or pushed into the latter by fluctuating crank case pressure. As a result, fuel is sucked up via the intake valve 32 from the fuel line 29 into the fuel chamber 31 and pumped out of the fuel chamber 31 via a discharge valve 33. The fuel passes via an inlet valve 34 into a control chamber 35 formed in the carburetor 25. The control chamber 35 is bounded by a control diaphragm 36. That side of the control diaphragm 36 which faces away from the control chamber 35 bounds a compensation chamber 37 which can be acted upon by the ambient pressure or by the pressure prevailing on the clean side of an intake air filter (not shown). The position of the inlet valve 34 is coupled to the position of the control diaphragm 36 via a lever 38. The lever 38 is pretensioned into the closed position of the inlet valve 34 by a spring 39. The fuel passes from the control chamber 35 to the secondary fuel openings 27 and to the main fuel opening 43.

Following a prolonged stoppage of the internal combustion engine 14, gas bubbles may accumulate in the fuel supply system. As a result, fuel or a sufficient quantity of fuel is not available when the internal combustion engine is started. In order to flood the fuel supply system with fuel prior to the starting of the internal combustion engine 14, a pump 40 which can be actuated manually by the operator is provided. The pump 40 is configured as a flushing pump. The pump 40 has the pump bulb or bellows 13 which protrudes from the housing 2 and, as a result, can be actuated in a simple manner by the operator. The pump bellows 13 bounds an interior space 44 which is connected to an intake line 42 via a first valve 45. The first valve 45 opens into the interior space 44 in the direction of flow. In the exemplary embodiment, the intake line 42 is connected to that region of the fuel supply system which supplies the fuel to the main fuel opening 43. However, the intake line 42 can also be connected to the control chamber 35 or to the secondary fuel openings 27. The interior space 44 of the pump bellows 13 is connected via a second valve 46, which opens from the interior space 44 in the direction of flow, to a discharge line 47 which leads into the fuel tank 11. If the pump bellows 13 is pressed by the operator, some of the fuel located in the interior space 44 is delivered via the second valve 46 and the discharge line 47 into the fuel tank 11. When the pump bellows 13 is released, the pump bellows 13 relaxes into the starting position thereof. In the process, fuel is sucked up from the fuel supply system via the first valve 45 into the interior space 44. As soon as a negative pressure prevails in the control chamber 35 because of the sucked-up fuel, the inlet valve 34 into the control chamber 35 opens and fuel from the fuel pump and the fuel line 29 flows into the control chamber 35. It is thereby also possible for the fuel pump 28 and the fuel line 29 to be flushed.

As an alternative or in addition, the pump 40 can serve to deliver fuel directly into the intake channel 22 when the internal combustion engine 14 is started. For this purpose, the discharge line 47 advantageously does not lead into the fuel tank 11, but rather into the intake channel 22. Starting enrichment can thereby be achieved in a simple manner. The pump 40 then does not serve as a flushing pump, or does not only serve as a flushing pump, but also as a start enrichment pump.

FIG. 2 shows a fuel supply system in which a carburetor is provided for the supply of fuel. FIG. 3 shows an alternative embodiment of a fuel supply system in which the fuel is supplied into the crank case 21 of the internal combustion engine 14 via a fuel valve 50. The same reference numbers here identify corresponding elements as in FIG. 2. In the case of the fuel supply system shown in FIG. 3, the fuel pump 28, a control system for the fuel pressure and the pump 40, which can be actuated by the operator, are arranged in a housing 49. The fuel pump 28 is connected via the fuel line 29 to a suction head 48 which is arranged in the fuel tank 11 and via which fuel is sucked up. The fuel passes via the intake valve 32 into the fuel chamber 31 and from there via the discharge valve 33 and the inlet valve 34 into the control chamber 35 of the pressure control system. The fuel pump 28 is driven by the fluctuating pressure in the crank case 21. For this purpose, a pulse line 72, which is shown schematically in FIG. 3, is provided. The pulse line 72 connects that side of the pump diaphragm 30 which faces away from the fuel chamber 31 to the interior space of the crank case 21. In the schematic in FIG. 3, the spring 39 which pretensions the inlet valve is shown schematically in the compensation chamber 37. A fuel line 52 leads from the control chamber 35 to a pressure controller 53. The fuel is supplied from there to the fuel valve 50. The fuel valve 50 is connected to the fuel tank 11 via a return line 55 in which a nonreturn valve 54 is arranged. The pump 40 which can be actuated by the operator is arranged in the fuel line 52 and comprises the first valve 45, the pump bulb or bellows 13 and the second valve 46. A nonreturn valve 51 is arranged between that portion of the fuel line 52 which leads to the first valve 45 and that portion of the fuel line 52 which is connected to the second valve 46. The nonreturn valve 51 opens in the direction of the fuel valve 50 and prevents fuel which is discharged from the second valve 46 from being sucked up again via the first valve 45 by the pump 40.

Prior to the starting of the internal combustion engine, the pump 40 is actuated a number of times by the operator. As a result, fuel is delivered from the fuel supply system together with the gas bubbles accumulated therein into the fuel tank 11, and fresh fuel is sucked up via the suction head 48 and the fuel supply system is flooded. As a result, fuel is available from the fuel supply system even as the internal combustion engine 14 is started.

Figure 4:
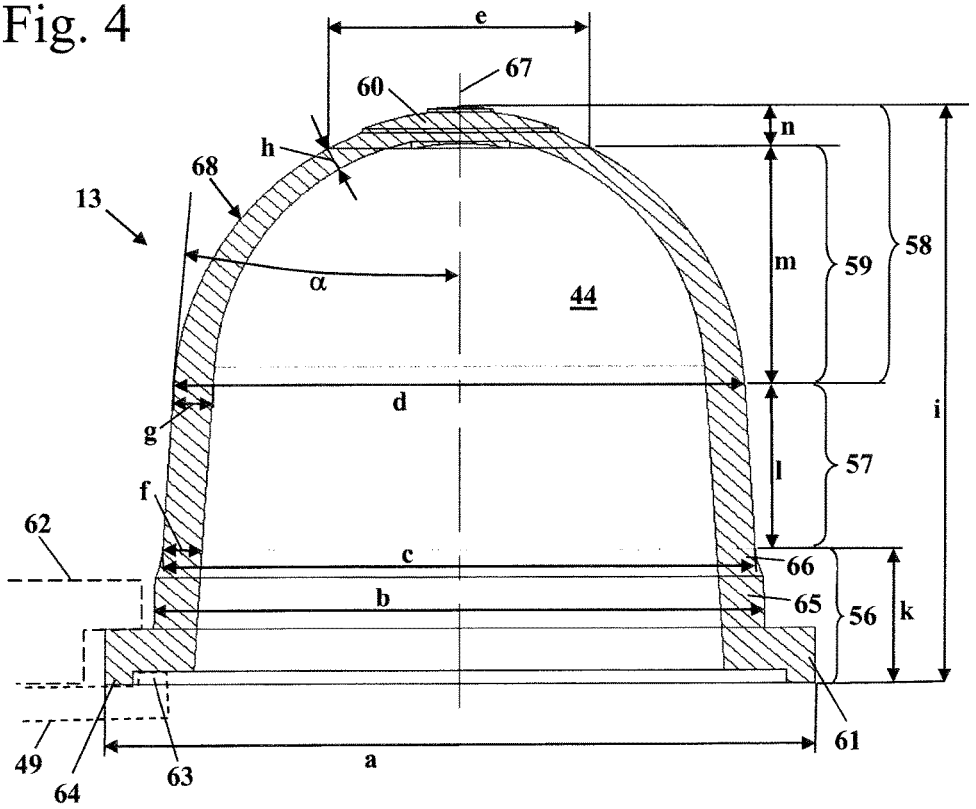
FIG. 4 shows the pump bellows of the pump, which is to be actuated by an operator, of the fuel supply systems from FIGS. 2 and 3, in section.

FIG. 4 shows the configuration of the pump bulb or bellows 13 in detail. As FIG. 4 shows, the pump bellows 13 has a fastening section 56 with which the pump bellows 13 is fixed on the housing 49. A holding element 62 serves for fixing the pump bellows 13. The housing 49 and the holding element 62 are shown schematically in FIG. 4. The fastening section 56 is adjoined by a main section 57 in which the pump bellows 13 has a cylindrical or slightly conical profile, that is, a profile in the shape of a truncated cone. The main section 57 is adjoined by a roof section 58. The roof section 58 comprises a dome-shaped section 59, which adjoins the main section 57, and a cap 60 which closes the dome-shaped section 59. The fastening section 56, the main section 57, the dome-shaped section 59 and the cap 60 extends between planes which are aligned perpendicularly to the center axis 67. The sections are accordingly formed by imaginary disks which would be produced when cutting through the pump bellows 13 with cuts aligned perpendicularly to the center axis 67.

The fastening section 56 has a border 61 to which the outside diameter of the pump bellows 13 is increased. At the border 61, the pump bellows 13 has an outside diameter (a) which can be, for example, from approximately 15 mm to approximately 25 mm. The holding element 62 rests on the border 61 and presses the border 61 against the housing 49. The inside of the pump bellows 13 has a recess 63, in which the housing 49 engages, on the border 61. That region of the border 61 which is located radially outside the recess 63 forms a holding section 64. The holding section 64 prevents the border 61 from being able to slip radially inward, that is, in the direction of the center axis 67 of the pump bellows 13, and from thereby being able to become detached from the holding element 62.

The border 61 is adjoined by a connecting section 65 in which the pump bellows 13 can be formed, for example, cylindrically or in the shape of a truncated cone. In the exemplary embodiment, the connecting section 65 is located within the holding element 62. The connecting section 65 can be partially or completely located within the holding element 62. At the connecting section 65, the pump bellows 13 has an outside diameter (b) which can be, for example, approximately 2 mm to approximately 5 mm smaller than the outside diameter (a). The connecting section 65 is adjoined by a transition section 66 in which the outer wall 68 of the pump bellows 13 has an arcuate profile in the exemplary embodiment. The outside diameter of the pump bellows 13 is reduced in the transition section 66 to an outside diameter (c) which can be, for example, approximately 2 mm to approximately 10 mm smaller than the outside diameter (b). The outside diameter (c) corresponds to the largest outside diameter of the main section 57. The fastening section 56 has a height (k) which is measured parallel to the center axis 67 and can be from approximately 15% to approximately 35% of the entire height (i) of the pump bellows 13. The center axis 67 is the line of symmetry of the pump bellows 13. The pump bellows 13 is rotationally symmetrical with respect to the center axis 67.

The main section 57 adjoining the fastening section 56 has a height (l) which can be approximately 25% to approximately 45% of the overall height (i) of the pump bellows 13. In the exemplary embodiment, the ratio of the height (l) to the overall height (i) is approximately 34% to 38%. The ratio of the height (l) to the largest diameter (c) of the main section 57 is advantageously from approximately 0.2 to approximately 0.4. The ratio of the height (l) to the diameter (c) is advantageously approximately 0.3 to approximately 0.35. That side of the main section 57 which faces the dome-shaped section 59 has an outside diameter (d). The outside diameter (d) is at least 75% of the largest diameter (c) of the main section 57. The diameter (d) is preferably more than 90% of the diameter (c). The diameter of the main section 57 can also be approximately constant. In the exemplary embodiment, the outside diameter in the main section 57 is slightly reduced. The outer wall 68 has a rectilinear profile in the section plane, which is shown in FIG. 4 and contains the center axis 67, and encloses an angle α, which is preferably at least 3°, with the center axis 67. As a result, the pump bellows 13, which is composed of plastic, can be removed from the mold in a simple manner.

The outside diameter is reduced very sharply in the dome-shaped section 59. The roof section 58 can be configured in section, for example, as a section of an arc of a circle, in particular approximately as a semicircle. That side of the dome-shaped section 59 which faces the cap 60 has an outside diameter (e) which is significantly smaller than the outside diameter (d) on the main section 57. The ratio of the outside diameter (e) to the outside diameter (d) is advantageously approximately 0.2 to approximately 0.5, preferably approximately 0.3 to approximately 0.4. The largest diameter (e) of the cap 60 is advantageously less than 50% of the largest outside diameter (c) of the main section 57. The dome-shaped section 59 has a height (m) which, advantageously, is greater than the height (l) of the main section 57 and greater than the height (k) of the fastening section 56. However, the height (m) is advantageously less than 50% of the overall height (i) of the pump bellows 13. The height (m) is advantageously approximately 35% to 45% of the overall height (i). In the dome-shaped section 59, in each sectional plane which contains the center axis 67, the outer wall 68 of the pump bellows 13 encloses an angle α with the center axis 67, which angle is greater than 3°, in particular greater than 5°. The dome-shaped section 59 advantageously begins in the region in which the outer wall 68 curves with respect to the center axis 67, whereas the outer wall 68 advantageously has a rectilinear profile in the main section 57 and is inclined by a constant angle to the center axis 67. If the outer wall 68 also is slightly curved in the main section 57, the dome-shaped section 59 begins at the point at which the outer wall 68 encloses an angle α of 3° with the center axis 67.

The cap 60 is that region of the pump bellows 13 which closes the dome-shaped section 59. The cap 60 has a height (n) which advantageously corresponds to less than 5%, in particular less than 10% of the overall height (i) of the pump bellows 13.

In order to achieve high resetting forces even at low temperatures, such that the pump bellows 13 is rapidly drawn outwards again from the pushed-in state, it is provided that the pump bellows 13 is of thickened shape in the region of the main section 57. The wall thickness of the pump bellows 13 decreases continuously in the dome-shaped section 59. The wall thickness at the cap 60 can be greater, in particular for manufacturing reasons. However, the region of the cap 60 is of subordinate importance for the resetting forces. As FIG. 4 shows, the main section 57 has its greatest wall thickness (f) on the side facing the fastening section 56. On the side facing the dome-shaped section 59, the pump bellows 13 has a wall thickness (g) which can be slightly smaller than the wall thickness (f). The wall thickness (g) is advantageously at most 10% smaller than the largest wall thickness (f) of the main section 57. The wall thicknesses (f) and (g) can also be approximately identical.

In the dome-shaped section 59, the wall thickness decreases continuously from the wall thickness (g) on the side facing the main section 57 to a wall thickness (h) on the side facing the cap 60. The smallest wall thickness (g) of the main section 57 is at least 10% greater than the smallest wall thickness (h) of the dome-shaped section 59. The smallest wall thickness (g) of the main section 57 is of thickened shape in relation to the smallest wall thickness (h) of the dome-shaped section 59. The smallest wall thickness (g) of the main section 57 is advantageously at least 20%, preferably at least 50% greater than the smallest wall thickness (h) of the dome-shaped section 59. In the exemplary embodiment, the smallest wall thickness (g) of the main section 57 is approximately 70% greater than the smallest wall thickness (h) of the dome-shaped section 59.

In order to achieve a good degree of elasticity of the pump bellows 13, it is provided that the pump bellows 13 is composed of plastic, preferably of a thermoplastic elastomer based on urethane.

FIG. 5 shows the pump bellows 13 in cross section, wherein the cross-sectional shape of a known pump bellows 73 is supplemented by cross hatching. The pump bellows 13 according to the invention differs from the known pump bellows 73 by a thickened region 69. The thickened region 69 is provided on the main section 57. The thickening here can be, for example, approximately 3 mm to approximately 8 mm. The thickened region 69 peters out in the dome-shaped section 59 in such a manner that a continuous outer contour without steps is produced. The dome-shaped section 59 is not thickened adjacent to the cap 60.

FIGS. 6 to 10 show the deformation of the pump bellows 13 when the pump bellows 13 is pushed in by a finger 70 (shown schematically). Only one half of the pump bellows 13 is shown in each case here. The other half of the pump bellows 13 behaves correspondingly on the basis of symmetry. The known shape of the pump bellows 13 is shown by a solid line and the new shape by a dashed line 71. FIG. 6 shows the pump bellows 13 in the unactuated state and FIG. 10 shows the latter in the pushed-in state. FIGS. 7 to 9 show intermediate stages. As FIGS. 6 and 7 show, the region of the cap 60 is pushed from the convex shape in FIG. 6 into the concave shape in FIG. 7. Upon further pushing in, shown in FIGS. 7 to 10, the dome-shaped section 59 rolls up inward. The thickened main section 57 is only slightly deformed outward. As a result, this region can apply a high resetting force. Owing to the small thickening in the dome-shaped section 59, the actuating forces are comparatively small. By means of the partial thickening of the pump bellows 13 in the main section 57, a small actuating force can thereby be achieved with simultaneous rapid resetting of the pump bellows 13 into the unactuated state shown in FIG. 6, even at low temperatures.

It is understood that the foregoing description is that of the preferred embodiments of the invention and that various changes and modifications may be made thereto without departing from the spirit and scope of the invention as defined in the appended claims.

What is claimed is:

1. A handheld work apparatus comprising:

a housing;

a fuel tank;

a fuel supply system;

a pump configured to convey fuel from said fuel supply system;

said pump having an elastic pump bulb configured to be actuated by a user;

said pump bulb defining an interior space and having an attachment section configured to connect said pump bulb to said housing;

a first valve configured to open into said interior space in a flow direction;

a second valve configured to open out of said interior space in said flow direction;

an intake line connected to said interior space via said first valve;

an outflow line connected to said interior space via said second valve;

said pump bulb further having a base section and a roof section;

said roof section having a dome-shaped section adjoining said base section and a cap adjoining and capping said dome-shaped section;

said pump bulb having an outer wall and an outer diameter (c, d, e) configured so as not to increase along said outer wall extending from the region of said base section adjoining said attachment section up to said cap in a direction of said cap;

said pump bulb defining a center axis parallel to said direction;

said outer wall of said pump bulb and said center axis enclosing an angle α which continuously increases in said dome-shaped section in the direction of said cap;

said dome-shaped section has a dome-shaped section wall thickness having a wall minimum thickness (h);

said base section has a base section wall thickness having a minimum wall thickness (g);

said minimum wall thickness (g) being at least 10% greater than said wall minimum thickness (h);

said dome-shaped section wall thickness continuously decreasing in the direction of said cap;

said cap having a cap wall thickness;

said cap wall thickness being greater than said wall minimum thickness (h) of said dome-shaped section;

said cap having a largest diameter (e);

said base section having a side facing said dome-shaped section;

said side having an outer diameter (d); and, a ratio of said largest diameter (e) to said outer diameter (d) lies in a range from 0.2 to 0.5.

2. The work apparatus of claim 1, wherein:

said base section wall thickness has a maximum wall thickness (f); and, said minimum wall thickness (g) is at most 10% less than said maximum wall thickness (f).

3. The work apparatus of claim 2, wherein said base section wall thickness is constant.

4. The work apparatus of claim 1, wherein:

said pump bulb has a height (i); and, said dome-shaped section extends over less than 50% of said height (i).

5. The work apparatus of claim 1, wherein:

said angle α is greater than 3° at every location.

6. The work apparatus of claim 1, wherein:

said base section has a first side facing said dome-shaped section and a second side facing said attachment section;

said first side has a diameter (d);

said second side has a diameter (c); and, said diameter (d) is at least 75% of said diameter (c).

7. The work apparatus of claim 1, wherein:

said base section has a greatest outer diameter (c);

said cap has a greatest outer diameter (e); and, said greatest outer diameter (e) is less than 50% of said greatest outer diameter (c).

8. The work apparatus of claim 1, wherein:

said base section has a greatest outer diameter (c) and a height (1); and, said height (1) having a ratio to said greatest outer diameter (c) lying in a range of 0.2 to 0.4.

9. A pump defining a flow direction, the pump comprising:

an elastic pump bulb defining an interior space and having an attachment section, a base section and a roof section;

said pump bulb being configured to be actuated by a user;

a first valve configured to open into said interior space in said flow direction;

a second valve configured to open out of said interior space in said flow direction;

an intake line connected to said interior space via said first valve;

an outflow line connected to said interior space via said second valve;

said roof section having a dome-shaped section adjoining said base section and a cap adjoining and capping said dome-shaped section;

said pump bulb having an outer wall and an outer diameter (c, d, e) configured so as not to increase along said outer wall extending from the region of said base section adjoining said attachment section up to said cap in a direction of said cap;

said pump bulb defining a center axis parallel to said direction;

said outer wall of said pump bulb and said center axis enclosing an angle α which continuously increases in said dome-shaped section in the direction of said cap;

said dome-shaped section has a dome-shaped section wall thickness having a wall minimum thickness (h);

said base section has a base section wall thickness having a minimum wall thickness (g);

said minimum wall thickness (g) being at least 10% greater than said wall minimum thickness (h);

said dome-shaped section wall thickness continuously decreasing in the direction of said cap;

said cap having a cap wall thickness;

said cap wall thickness being greater than said wall minimum thickness (h) of said dome-shaped section;

said cap having a largest diameter (e);

said base section having a side facing said dome-shaped section;

said side having an outer diameter (d); and, a ratio of said largest diameter (e) to said outer diameter (d) lies in a range from 0.2 to 0.5.

10. A pump bulb for a pump defining a flow direction, the pump bulb comprising:

an attachment section;

a base section;

a roof section having a dome-shaped section adjoining said base section and a cap adjoining and capping said dome-shaped section;

said pump bulb having an outer wall and an outer diameter (c, d, e) configured so as not to increase along said outer wall extending from the region of said base section adjoining said attachment section up to said cap in a direction of said cap;

said pump bulb defining a center axis parallel to said direction;

said outer wall of said pump bulb and said center axis enclosing an angle α which continuously increases in said dome-shaped section in the direction of said cap;

said dome-shaped section has a dome-shaped section wall thickness having a wall minimum thickness (h);

said base section has a base section wall thickness having a minimum wall thickness (g);

said minimum wall thickness (g) being at least 10% greater than said wall minimum thickness (h);

said dome-shaped section wall thickness continuously decreasing in the direction of said cap;

said cap having a cap wall thickness;

said cap wall thickness being greater than said wall minimum thickness (h) of said dome-shaped section;

said cap having a largest diameter (e);

said base section having a side facing said dome-shaped section;

said side having an outer diameter (d); and, a ratio of said largest diameter (e) to said outer diameter (d) lies in a range from 0.2 to 0.5.

* * * * *